US007490555B2

(12) United States Patent
Veksler

(10) Patent No.: US 7,490,555 B2
(45) Date of Patent: Feb. 17, 2009

(54) METHOD OF CONVERTING A CLUSTER BOMB INTO A UNITARY BOMB

(75) Inventor: Isar Veksler, Herzliya (IL)

(73) Assignee: Israel Military Industry Ltd., Ramat Hasharon (IL)

( * ) Notice: Subject to any disclaimer, the term of this patent is extended or adjusted under 35 U.S.C. 154(b) by 20 days.

(21) Appl. No.: 11/637,761

(22) Filed: Dec. 13, 2006

(65) Prior Publication Data

US 2008/0035005 A1 Feb. 14, 2008

(30) Foreign Application Priority Data

Dec. 14, 2005 (IL) ..... 172589

(51) Int. Cl.
*F42B 33/06* (2006.01)
*F42B 12/20* (2006.01)
*F42B 12/58* (2006.01)
*F42D 5/04* (2006.01)

(52) U.S. Cl. ..... 102/393; 102/489; 102/499; 102/396; 86/50; 86/56

(58) Field of Classification Search ..... 102/393, 102/489, 499, 473, 477, 478, 396; 86/50, 86/49, 56; 588/403
See application file for complete search history.

(56) References Cited

U.S. PATENT DOCUMENTS

| | | | | | |
|---|---|---|---|---|---|
| 5,076,171 | A * | 12/1991 | Altenau et al. | ..... | 102/489 |
| 5,210,372 | A * | 5/1993 | Tripptrap et al. | ..... | 102/489 |
| 5,317,975 | A * | 6/1994 | Sauvestre et al. | ..... | 102/489 |
| 5,473,988 | A * | 12/1995 | Dion | ..... | 102/489 |
| 5,789,695 | A * | 8/1998 | Scherer et al. | ..... | 86/49 |
| 6,874,425 | B1 * | 4/2005 | Doughty | ..... | 102/489 |
| 7,121,210 | B2 * | 10/2006 | Steele | ..... | 102/211 |

FOREIGN PATENT DOCUMENTS

| | | | |
|---|---|---|---|
| DE | 1703781 | B * | 9/1974 |
| DE | 196 44 223 | A1 | 4/1998 |
| EP | 481874 | A1 * | 4/1992 |
| EP | 0 743 502 | A1 | 11/1996 |
| EP | 1798514 | A1 * | 6/2007 |
| FR | 2 813 119 | A1 * | 2/2002 |
| WO | WO 00/37880 | | 6/2000 |

* cited by examiner

*Primary Examiner*—James S Bergin
(74) *Attorney, Agent, or Firm*—Bacon & Thomas, PLLC

(57) ABSTRACT

A method of converting a cluster bomb having an expelling charge and submunitions into a unitary bomb, the method comprising: preparing the cluster bomb for the insertion of a shock wave destructive charge including removing the expelling charge; and inserting the shock wave destructive charge into the cluster bomb such that the destructive charge operatively contacts at least one submunition.

5 Claims, 3 Drawing Sheets

METHOD OF CONVERTING A CLUSTER BOMB INTO A UNITARY BOMB

FIELD OF INVENTION

The present invention relates to conversion of cluster bombs into unitary bombs.

BACKGROUND OF THE INVENTION

Cluster bombs dispense submunitions, often referred to as bomblets, and are commonly used to provide for multiple detonations above a target. At some point after launching, the submunitions are dispensed as a result of a time fuze or proximity fuze at a predetermined height above the target in a spread out pattern.

In the more common types of cluster bombs, the fuze ignites an expelling charge that pushes a piston to expel the submunitions from the bomb or dispenser. When they fall, the submunitions tend to explode when they hit the ground. Unexploded submunitions stay on top of the ground, unlike regular bombs which tend to bury themselves into the earth such that, even in cases where they do not explode, they are generally harmless.

Contrary to this, unexploded bomblets (duds), which tend to remain on the ground's surface, are left long after a conflict ends and these duds often maim and kill unintended victims. The tendency for duds increases with the age of the submunitions and at some point they become obsolete and they need to be destroyed, as leaving behind duds is clearly an unwanted side-effect of using the cluster bombs.

Destroying cluster bombs is expensive and time consuming and there has been a long-felt need to provide a remedy to this issue.

SUMMARY OF THE INVENTION

Accordingly, the present invention relates to a method of destroying or otherwise utilizing a cluster bomb, in particular by converting the cluster bomb into a unitary or single-hit bomb; and it relates to the unitary bomb thereby produced.

The method of the present invention relates to converting a cluster bomb having an expelling charge and submunitions into a unitary bomb, the method comprising: preparing said cluster bomb for the insertion of a shock wave destructive charge including removing said expelling charge; and inserting said shock wave destructive charge into said cluster bomb such that said destructive charge operatively contacts at least one submunition.

The bomb of the present invention relates to a unitary bomb comprising a fuse; submunitions and a shock wave detonation charge operatively connected to at least one of said submunitions.

In addition to disclosing a convenient means for providing bombs, which, for example, can be used in training exercises, thus achieving the destruction of otherwise obsolete cluster bombs, the method also may reduce the tendency to use older cluster bombs, for example, in training exercises or military operations. This in turn reduces the amount of unexploded submunitions thereby reducing the maiming and killing which often occurs long after the end of military operations.

DETAILED DESCRIPTION OF THE DRAWINGS

The invention may be more clearly understood upon reading of the following detailed description of non-limiting exemplary embodiments thereof, with reference to the following drawings, in which.

DETAILED DESCRIPTION OF THE INVENTION

Figure 1:
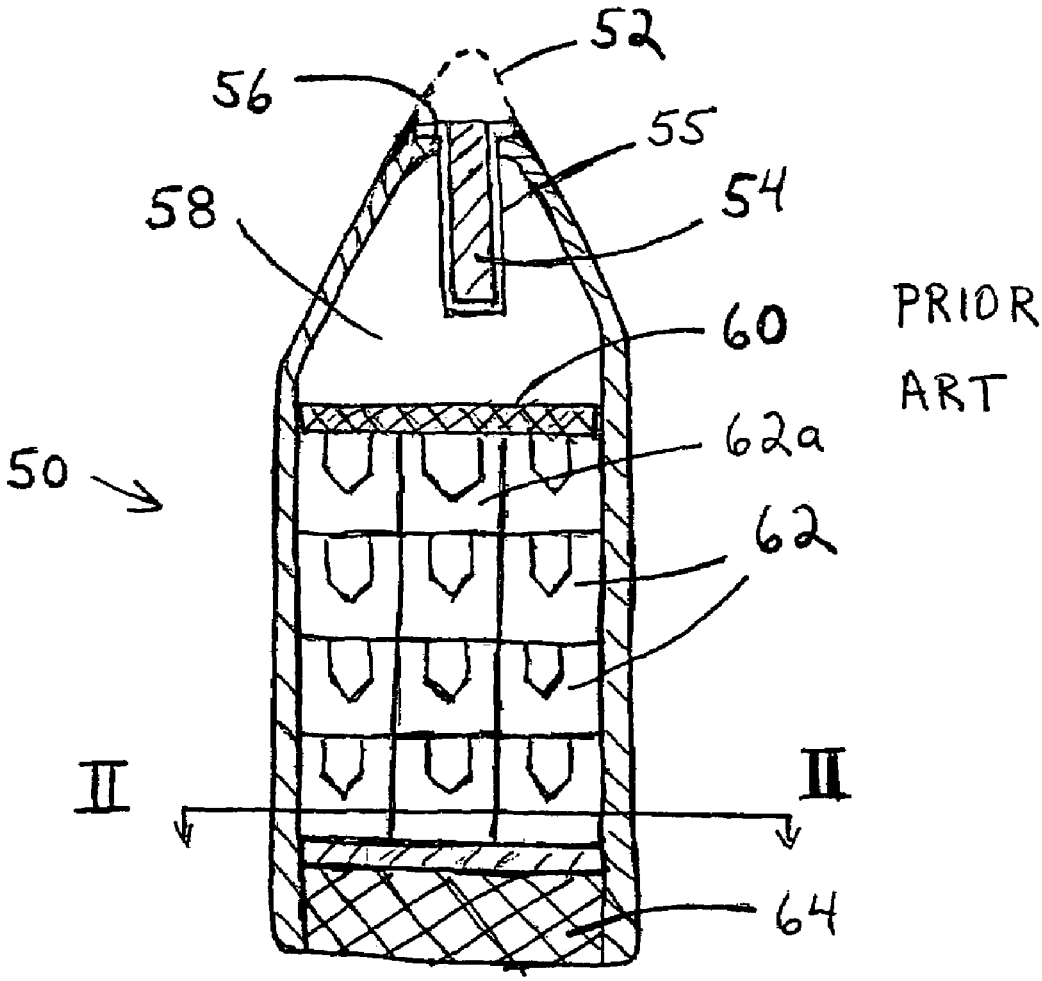
FIG. 1 is a cross-section of a typical (prior art) cluster bomb.

FIG. 1 shows a cross-section of a typical (prior art) cluster bomb 50. It comprises a fuze 52, an expelling charge 54 held by a holding cup 55 at an annular shoulder 56, disposed in a space 58 and positioned by, a piston 60, submunitions 62 and a base 64. The fuze 52 is shown with dashed lines as cluster bombs are typically not shipped with fuzes and they are added afterward so that the particular desired fuze can be assembled to the bomb.

Figure 2:
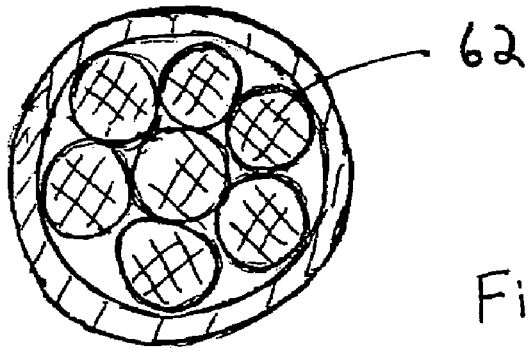
FIG. 2 is a cross-section along the line II-II of FIG. 1.

FIG. 2 illustrates a typical arrangement of the submunitions 62 in the cluster bomb 50.

At a predetermined proximity or time after the cluster bomb 50 is fired, the fuze 52 ignites the expelling charge 54 providing a force on the piston 60 whereby the submunitions 62 are expelled from the cluster bomb 50 via the base 64, which is sheared due to the force of the expelling charge.

Figure 3:
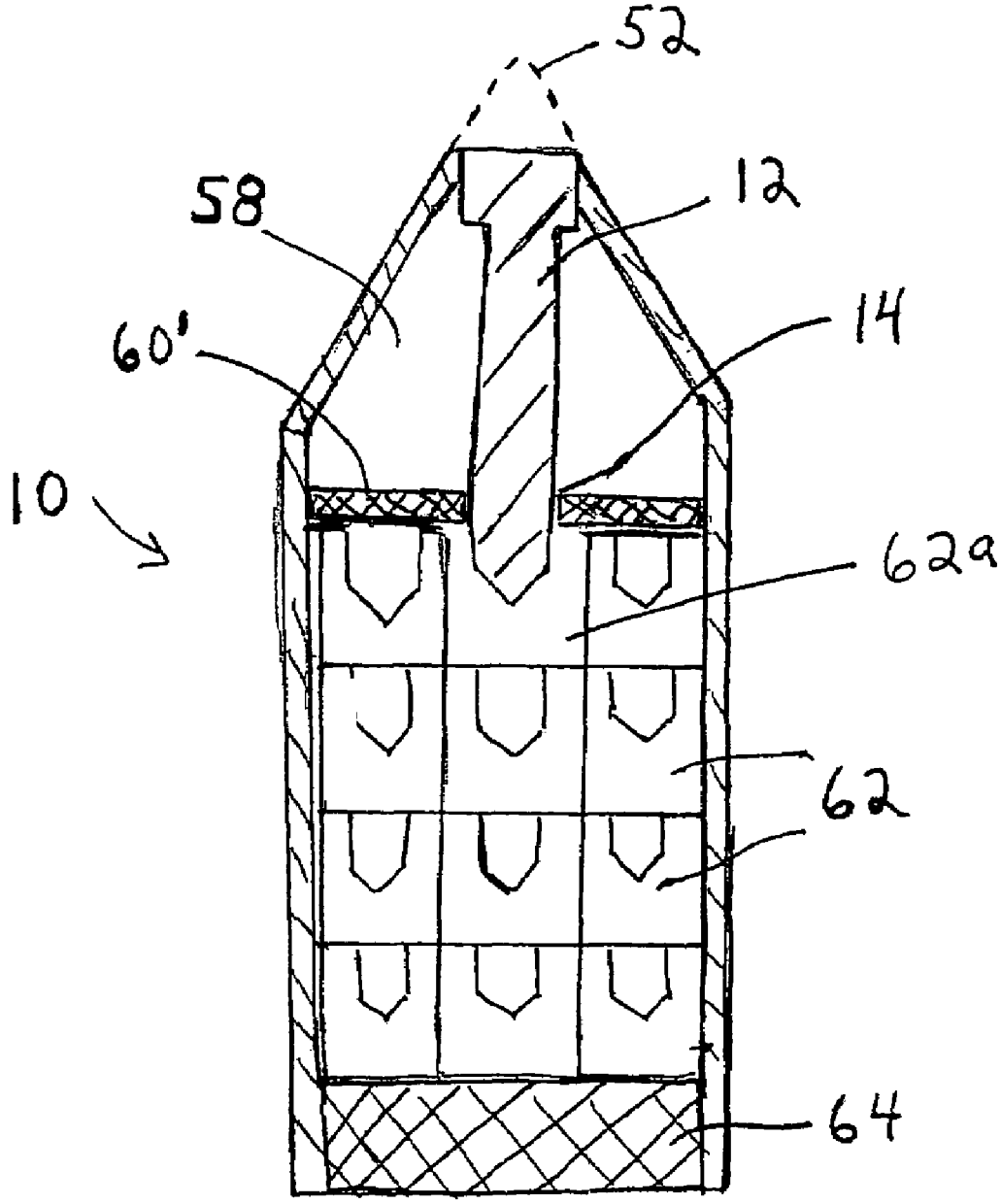
FIG. 3 is a cross-section of a unitary bomb converted from a cluster bomb according to the present invention.

FIG. 3 shows a unitary bomb 10 produced by a method according to the present invention, namely, converted from a cluster bomb, such as cluster bomb 50. The unitary bomb 10 is shown without a fuse for the reason explained above with reference to FIG. 1.

The bomb 10 comprises a detonation charge, in particular a shock wave destructive charge (SWDC) 12.

It is a particular feature of the present invention that the destructive charge is a shock wave destructive charge in that such a charge tends to provide for a particularly rigorous detonation of the submunitions 62. In fact, a series of tests have been conducted, and the converting method of the present invention resulted in a 100% destruction of the submunitions 62 in all of the tests.

In contrast, other types of charges, for example, shaped charges, often result in less than 100% detonation of the submunitions.

Without limitation to theory, it is believed that the SWDC 12 used in the method and bomb of the present invention provides for an essentially higher order detonation of the submunitions 62 due to its producing a shock wave into the center of the array of submunitions 62 whereas other types of destructive charges may be affected by the bomb's spinning when in flight, which may result in low order detonation and therefore less than 100% detonation of the submunitions.

Further noticed in FIG. 3, is (a) that the SWDC 12 protrudes through an opening 14 which has been made (e.g. machined) in the center of the piston, now designated as 60', (b) that the SWDC 12 is in "operative contact" (typically almost in contact, in a less than 1 mm proximity; or in direct contact) with one of the submunitions 62 (i.e. the central proximate submunition, designated as 62*a*), and (c) that the annular shoulder 56 has been removed (e.g. machined) to allow for entry of the SWDC 12, which is now held in place by the piston opening 14.

Operational contact between the SWDC 12 and the proximate submunition 62*a* (typically direct or near contact) is necessary in order to ensure proper and complete detonation of all of the submunitions 62.

Figure 4:
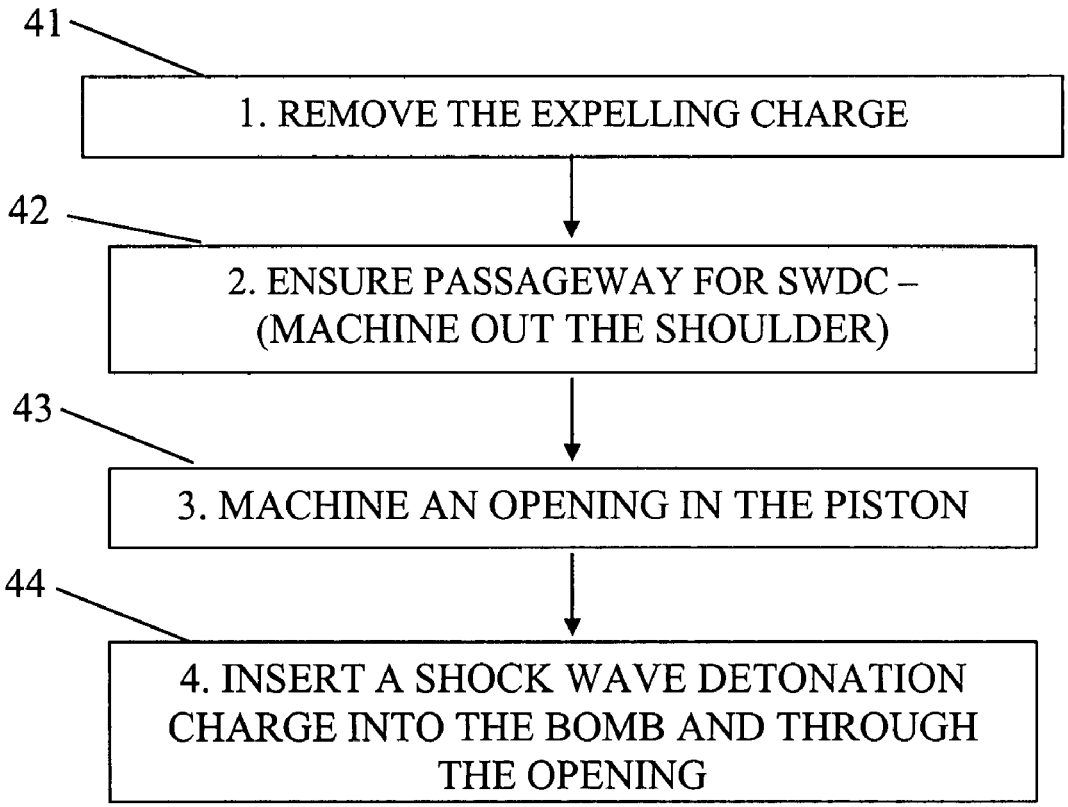
FIG. 4 is a flowchart of a method for converting a cluster bomb into a unitary bomb according to the present invention.

In FIG. 4, a flowchart of a method according to the present invention for converting a cluster bomb into a unitary bomb, such as unitary bomb 10, is presented; and it will be described with reference to the components referred to herein above.

In a first step 41, the existing expelling charge 54 is removed, and in a second step 42, an appropriate passageway for inserting the SWDC 12 is ensured, typically entailing removing shoulder 56, e.g., by machining. In a third step 43, the piston opening 14 is made in the center of the piston 60, also typically by machining; the size of the opening typically corresponding to the diameter of the SWDC 12. In a fourth step 44, the SWDC 12 is inserted and glued in place through the piston opening 14, else held by a sliding fit therein, to a point of operational contact with the proximate submunition 62*a*. At this point, the bomb 10 is ready for a fuze, such as fuze 52 to be attached whereby it is ready for firing.

The above description has been provided with respect to a typical cluster bomb, as exemplified herein. It should be understood that if the cluster bomb provided is different from the one exemplified, various embodiments of the present invention can be devised. For example, if the cluster bomb provided does not comprise a shoulder (e.g. shoulder 56) or other obstacle for inserting an appropriate destructive charge (e.g. SWDC 12), then there is obviously no need for it to be removed. Thus, in effect, the cluster bomb provided must merely be in a condition for the insertion of a destructive charge, preferably wherein the charge is a shock wave destructive charge and that the charge almost contacts or contacts a submunition either directly or there is, or at least almost, a metal-to-metal contact provided (i.e. there is "operative contact").

Likewise, other variances on the cluster bomb provided for converting would potentially require more or less steps and possibly different steps and these would none-the-less fall within the scope of the invention.

In accordance with the method of the present invention, a unitary bomb as described above can be produced and be available for use, for example, in training exercises, without concern for duds remaining on the training field, which may endanger lives. Also, there should hopefully be less of a tendency to use older cluster bombs and thus a corresponding reduction in the number of unexploded submunitions waiting to maim and kill innocent passers-by after the cessation of a conflict. In addition, the above present method provides for a way to destroy otherwise obsolete cluster bombs.

It should be understood that there are various methods of converting a cluster bomb into a unitary bomb that can be devised according to the present invention and that the above description is merely explanatory. Thus, the present method and unitary bomb can be embodied in a variety of aspects falling within the scope of the present invention, *mutatis mutandis*.

The invention claimed is:

1. A method of converting a cluster bomb having an expelling charge and submunitions into a unitary bomb, said method comprising:

preparing said cluster bomb for the insertion of a shock wave destructive charge including removing said expelling charge;

positioning the destructive charge such that it is capable of initiating the submunitions to explode and to be destroyed; and inserting said shock wave destructive charge into said cluster bomb such that said destructive charge operatively contacts at least one submunition.

2. The method according to claim 1, wherein the cluster bomb comprises a shoulder for holding the expelling charge and the preparing comprises removing said shoulder.

3. The method according to either of claim 1 or 2, wherein the cluster bomb comprises a piston and the preparing comprises providing an opening in said piston to allow the destructive charge to pass therethrough.

4. A unitary bomb comprising a fuse, submunitions and a shock wave destructive charge operatively connected to at least one of said submunitions wherein the destructive charge is capable of initiating the submunitions to explode and to be destroyed.

5. The unitary bomb according to claim 4, wherein the destructive charge is in operative contact with the submunitions.

* * * * *